US008915523B2

(12) United States Patent
Tillman et al.

(10) Patent No.: US 8,915,523 B2
(45) Date of Patent: Dec. 23, 2014

(54) PANIC HARDWARE DOGGING RELEASE DEVICE

(76) Inventors: Scott Christopher Tillman, Brazil, IN (US); Jeffrey Edward Bensinger, Terre Haute, IN (US)

( * ) Notice: Subject to any disclaimer, the term of this patent is extended or adjusted under 35 U.S.C. 154(b) by 55 days.

(21) Appl. No.: 13/251,579

(22) Filed: Oct. 3, 2011

(65) Prior Publication Data

US 2012/0133156 A1 May 31, 2012

Related U.S. Application Data

(60) Provisional application No. 61/458,634, filed on Nov. 29, 2010.

(51) Int. Cl.
*E05B 65/10* (2006.01)
*E05B 13/00* (2006.01)

(52) U.S. Cl.
CPC ..... *E05B 65/1093* (2013.01); *E05B 13/007* (2013.01)
USPC ..... 292/92; 292/93; 292/119; 70/92

(58) Field of Classification Search
CPC ..... E05B 13/007; E05B 65/1093
See application file for complete search history.

(56) References Cited

U.S. PATENT DOCUMENTS

| | | | | | |
|---|---|---|---|---|---|
| 2,049,144 | A * | 7/1936 | Wahlberg | 74/543 |
| 2,719,744 | A * | 10/1955 | Schlage | 292/1 |
| 2,724,609 | A * | 11/1955 | Donnelly | 292/266 |
| 2,945,372 | A * | 7/1960 | Reed | 70/92 |
| 3,530,695 | A * | 9/1970 | Balducci | 70/92 |
| 3,563,585 | A * | 2/1971 | Welch | 292/92 |
| 3,614,145 | A * | 10/1971 | Zawadzki | 292/92 |
| 4,083,590 | A * | 4/1978 | Folger | 292/92 |
| 4,167,280 | A * | 9/1979 | Godec et al. | 292/92 |
| 4,968,070 | A * | 11/1990 | Choi | 292/92 |
| 5,016,927 | A * | 5/1991 | Toledo | 292/92 |
| 5,074,602 | A * | 12/1991 | Hwang | 292/173 |
| 5,490,696 | A * | 2/1996 | Hutson | 292/92 |
| 6,623,050 | B1 * | 9/2003 | Peng | 292/92 |
| 6,820,905 | B1 * | 11/2004 | Haeck et al. | 292/93 |
| 7,832,777 | B2 * | 11/2010 | Banks et al. | 292/92 |
| 8,070,192 | B2 * | 12/2011 | Tien | 292/92 |
| 2001/0005996 | A1 * | 7/2001 | Haeck et al. | 70/92 |
| 2006/0255596 | A1 * | 11/2006 | Yong | 292/173 |
| 2008/0295416 | A1 * | 12/2008 | Kintz | 49/506 |
| 2011/0192201 | A1 * | 8/2011 | Lin | 70/92 |
| 2012/0261928 | A1 * | 10/2012 | Dye et al. | 292/201 |
| 2014/0109479 | A1 * | 4/2014 | Morstatt et al. | 49/32 |

* cited by examiner

*Primary Examiner* — Kristina Fulton
*Assistant Examiner* — Thomas Neubauer
(74) *Attorney, Agent, or Firm* — Maginot, Moore & Beck LLP

(57) ABSTRACT

An apparatus provided for releasing the dogging function of a panic device for an exit door without the use of a key or other external device includes an end cap button; an adjustable connecting rod assembly; and a modified latch plate; Depressing the end cap button pushes the rod assembly to rotate the modified latch plate to release the dogging function of the panic device.

8 Claims, 8 Drawing Sheets

DOGGED POSITION

FIG. 1 DOGGED (UNLOCKED) POSITION

FIG. 2 UN-DOGGED (LOCKED) POSITION

FIG. 3 DOGGED POSITION

FIG. 4 UN-DOGGED POSITION

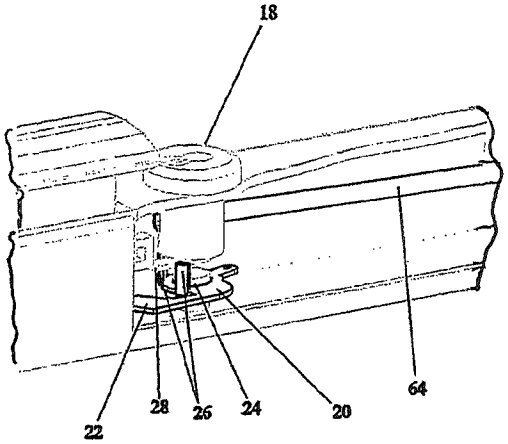
FIG. 8 UN-DOGGED

PANIC HARDWARE DOGGING RELEASE DEVICE

CROSS-REFERENCE TO RELATED APPLICATION

This application is a utility filing from and claims priority to Provisional Application No. 61/458,634, filed on Nov. 29, 2010, the entire disclosure of which is incorporated herein by reference.

BACKGROUND OF THE INVENTION

The present disclosure relates to the field of door security systems and more specifically to a mechanism operable with the existing panic device to release the dogging mechanism without the use of an external key or similar external device.

Door exit devices, also referred to as panic exits or fire exits, are typically operated from the inside of an outward swinging door and are designed to provide building occupants fast and easy egress in an emergency. A door exit device generally comprises a manually actuated latch release mechanism releasing a door latch responsive to a relatively minimal force applied in the direction of egress travel through the doorway. The manually actuated release mechanism includes a readily accessible push pad or crossbar rail extending at least halfway across the width of the door.

With safety of building occupants as its primary function, a door exit device must always release the door latch, allowing exit without special access authorization or significant door operation knowledge. Any minimally sufficient horizontal push force applied to the outer vertical surface of a push pad type exit device retracts the latch bolt and releases the door to be opened. Several exit device designs have been designed and utilized including rim type, vertical rod, and mortise lock type devices. Examples of such devices are disclosed in U.S. Pat. No. 4,466,643, to Godec at al.; U.S. Pat. No. 5,016,927 to Toledo; U.S. Pat. No. 5,184,852 to O'Brien; and U.S. Pat. No. 5,927,765 to Austin et al.

Many of these panic devices have a dogging function which allows the panic device to be intentionally placed into an unlocked and unsecure position. This is achieved by means of a cylinder or hex key latching of the panic device when in the depressed push pad state. One example of such a device is shown in U.S. Pat. No. 4,968,070 to Choi. Currently the functionality will only allow the panic device hardware to be locked/unlocked by means of this hex key or cylinder key.

There is a need for an apparatus that will allow the locking of the panic device hardware in a quick manner without the need of a hex key or cylinder key. One benefit of this added functionality is that any individual can lock the panic device door without the need for a hex key or cylinder key. This feature would provide an added security to the door if a need arises requiring the immediate securing of the door. Currently only building owners with the hex key or cylinder key can lock the panic device door if the panic device is in the dogged down (always unlocked) position.

There remains a need for an exit device apparatus, system and method that efficiently and quickly releases the dogging function of the panic device. The present invention addresses such a need and other needs not addressed by the prior art.

SUMMARY OF THE INVENTION

A door exit device, security, and method are provided for releasing the dogging function of the panic device in a quick and efficient manner without the need of a key of other mechanical device. The quick panic release device provides securing of a door into the locked position with a depressing of the end cap button. This depressing of the button actuates and releases the dogging function thereby placing the door in a secure locked mode relative to the exterior side of the device. Exiting the door from within is still allowed as normally intended by depressing of the panic device bar. The panic device will remain in the locked position and access back in through the door will only be granted by those in possession of a key to the rim cylinder lock.

The above as well as additional objects, features, and advantages of the present invention will become apparent in the following detailed written description.

BRIEF DESCRIPTION OF THE DRAWINGS

The features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 8 is an enlarged 3-D view of a well-known key-operated dogging mechanism.

DETAILED DESCRIPTION

The present invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the present invention. Furthermore, each panic device manufacturer has variations of the latch mechanism by which the dogging function is achieved. This invention is intended to apply to the desired means of releasing the dogging function and will require the connection to this latch to be adapted so as to provide this quick panic release without compromising the existing function of the device.

Figure 1:
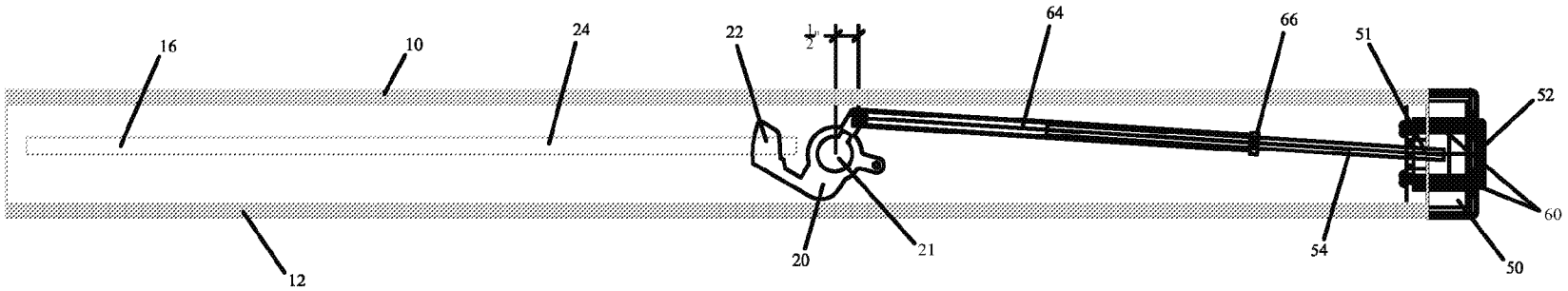
FIG. 1 is a plan view of a door exit device in accordance with one embodiment of the present invention in the dogged unlocked) position.
Figure 2:
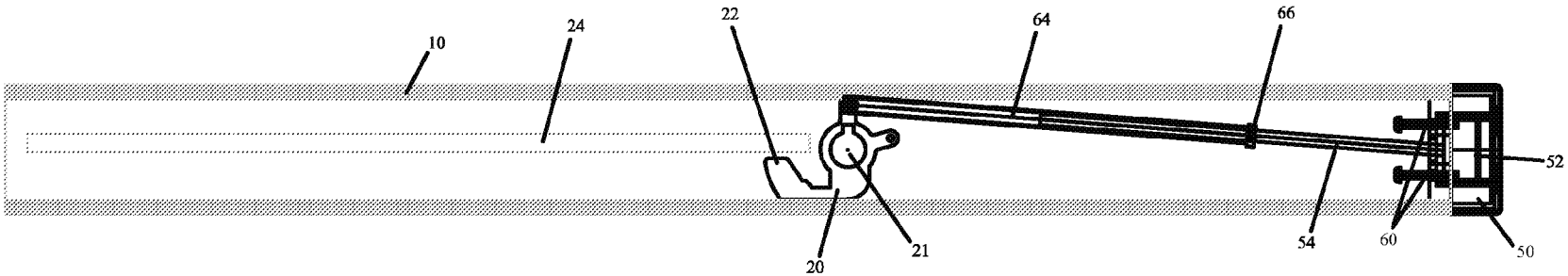
FIG. 2 is a plan view of a door exit device in accordance with one embodiment of the present invention in the un-dogged (locked) position.
Figure 3:
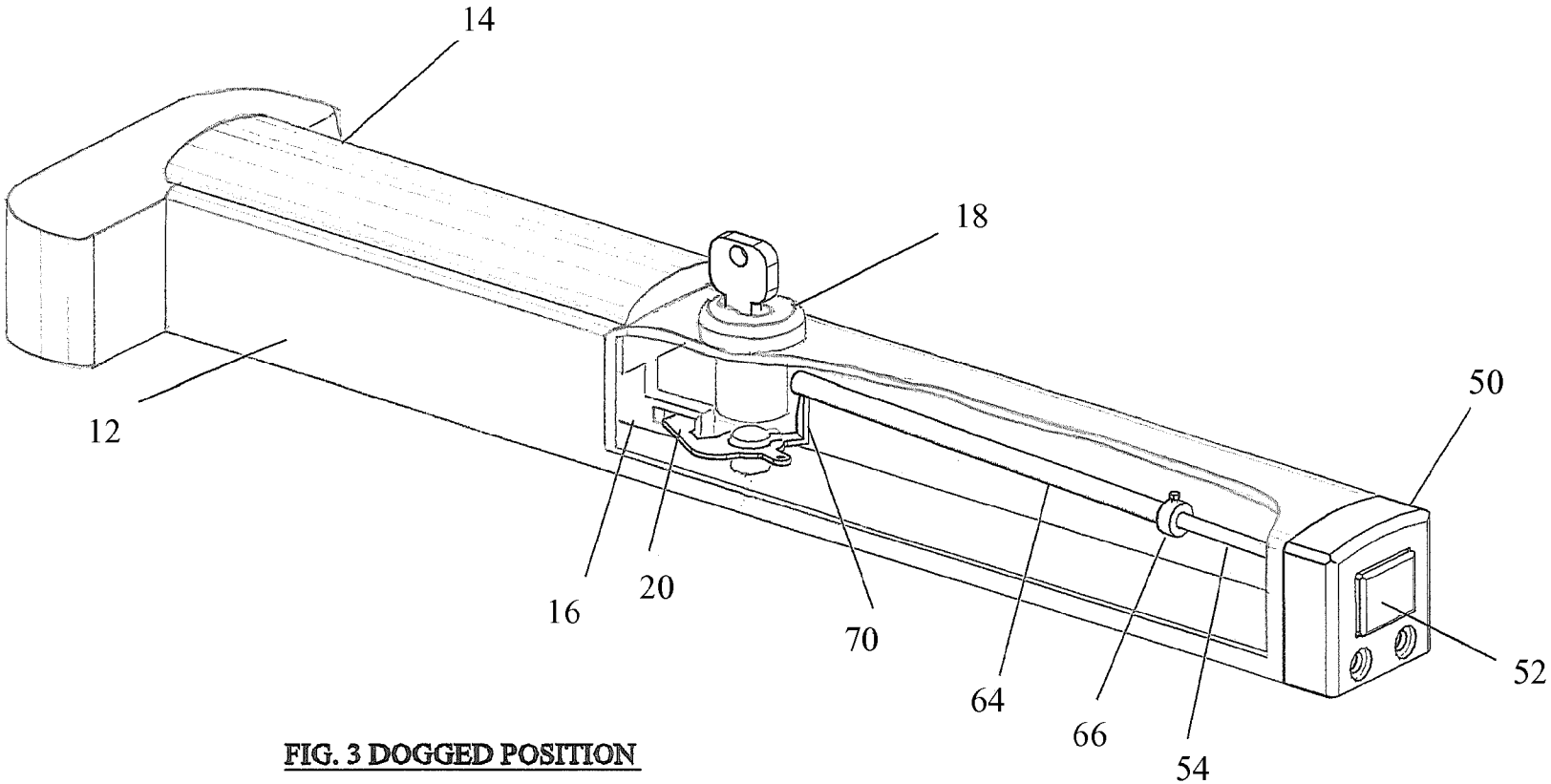
FIG. 3 is a cutaway 3D view of the door exit device of the present invention in the dogged (unlocked) position.
Figure 4:
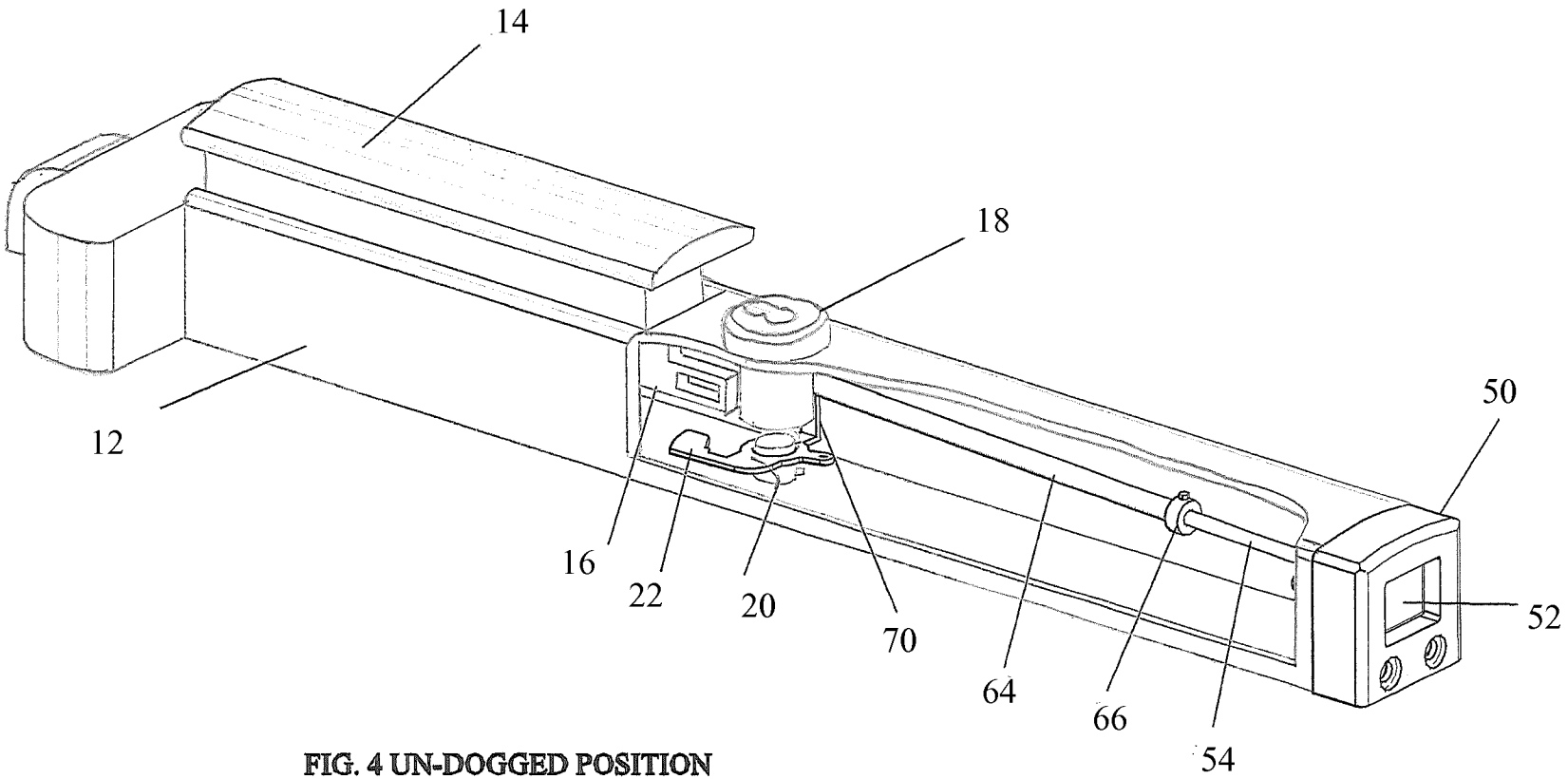
FIG. 4 is a cutaway 3D view of the door exit device of the present invention in the un-dogged (locked) position.

As shown in FIGS. 1-4, the mechanism of the present disclosure is contemplated for integration into an existing panic device 10 having a housing 12, an occupant depressible panic bar 14 and an internal mechanism 16 for releasing the door latch (see FIG. 4) in response to the panic bar being depressed. The panic device 10 includes a key-operated locking/unlocking or dogging mechanism 18 that is operated to rotate a latch plate 20 to a position in which a latch 22 engages a rod 24 of the existing panic hardware 16 to prevent movement of the rod and thereby prevent release of the panic device push bar 14. This "dogged" or unlocked position, as shown in FIGS. 1, 3, thus holds the panic device, and thereby the exit door, in its unlocked position and does not permit any unauthorized person from releasing and locking the door. A hex or cylinder key is required to operate the dogging mechanism 18 to rotate the latch plate 20 to the "undogged" position shown in FIGS. 2, 4 in which the latch 22 is released from the rod 24 to thereby release the panic device push bar 14 and allow the device and exit door to be held in the locked position. One exemplary key-operated dogging mechanism that is well-known in the art is shown in FIG. 8 in which a cylinder tab 28 engages tabs 26 on the latch plate 20 to rotate the latch plate with rotation of the key.

Figure 5:
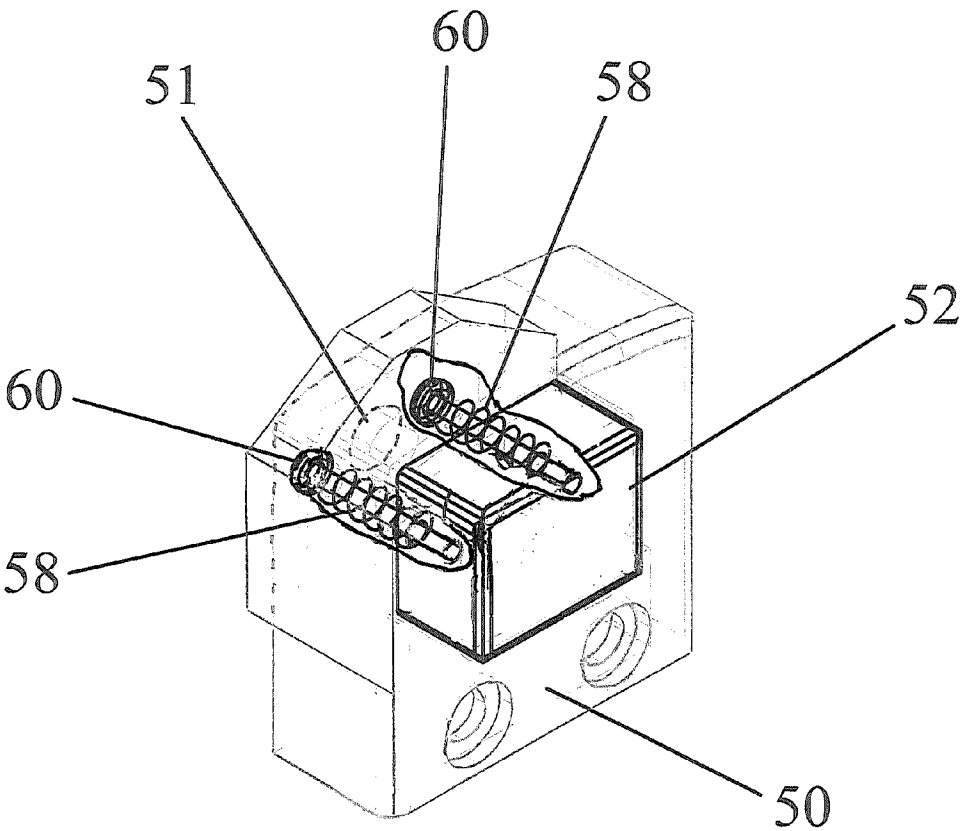
FIG. 5 is an enlarged view of the end cap button and spring actuation.
Figure 6:
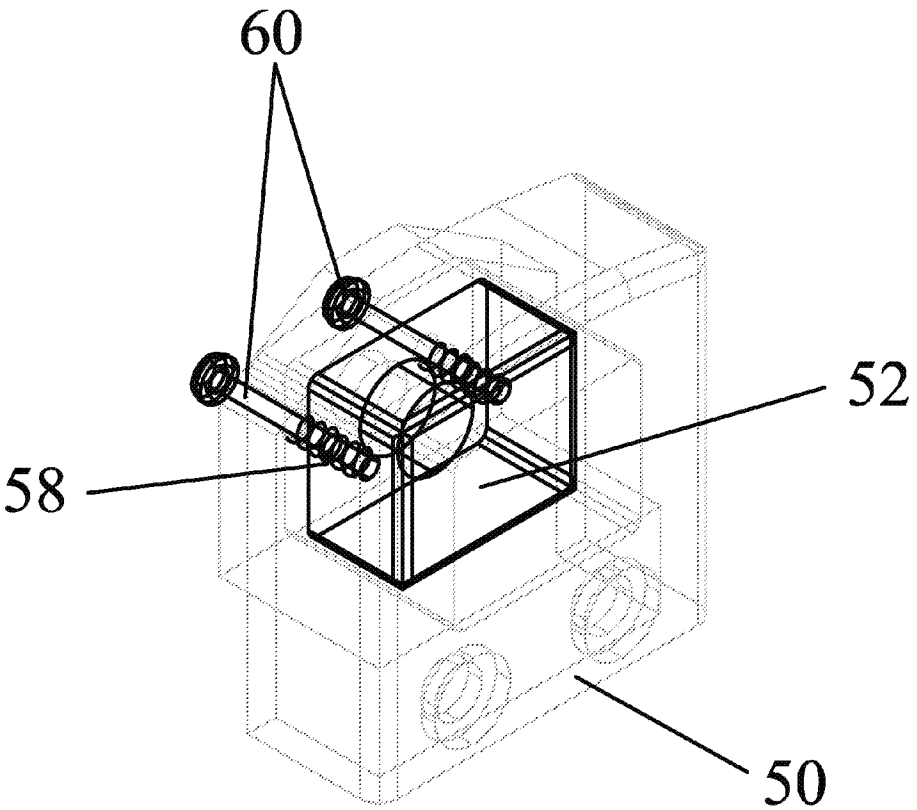
FIG. 6 is an enlarged view of the end cap button and spring actuation in the depressed state.

The quick latch release functionality is achieved by the replacement of the existing end cap (not shown) of the panic device with a new end cap 50 that has a built-in button 52. An internal connecting rod 54 protrudes from the back side of the end cap 50 through a hole 51 (FIG. 5) into the interior of the panic device 10. The connecting rod 54 is telescopically coupled to an adjustable tube 64 by a set collar 66 to form an adjustable connecting rod assembly. The set collar includes a lock screw that fixes the tube 64 and shaft 54 together at adjustable lengths. The adjustable tube 64 is engaged at its opposite end to the latch plate 20. The button 52 is biased outward by a pair of springs 58 disposed over two holding screws 60 (best seen in FIG. 5). Depressing the button 52 (FIG. 6) places a force on the connecting shaft 54 which pushes the adjustable tube 64 and thus activates lever plate 20 that is part of the locking/unlocking dogging latch mechanism to move the latch 22 to the un-dogged position shown in FIGS. 2, 4. After the button is released the springs 58 force the button back to the original position (FIG. 5), but the internal connecting shaft 54 and dogging latch 20 remain in the pushed state, or un-dogged position, since they are not mechanically connected to the button.

In one aspect of the present device, the existing panic dogging latch plate would be replaced with new latch plate 20 that provides a point of connection that facilitates the release of the dogging function of the panic bar, as described in more detail below. The pushing of the end cap button 52 will only release the dogging function that keeps the panic bar in the always unlocked position (FIGS. 1,3), thereby locking the panic door to the outside of the room. The panic bar operation will continue to function as normal operation, whereby depressing the panic bar will open the door from the inside of the room. Reactivation of the dogging function will only be achieved by use of the existing locking mechanism 18 by way of a]hex key or cylinder key, thereby only allowing authorized individuals to unlock or "dog down" the panic device. This is critical in not allowing the door to be left unlocked by unauthorized persons.

As is known, panic bar devices can be of various lengths which are determined by the size of the door and various manufacturers. These panic devices are field cut by the installer during the initial installation as per door size and site condition. To accommodate the variations in lengths, the connecting rod from the push button 52 to the latch plate needs to be adjustable. This can be achieved by the connecting rod 54 that fits inside tube 64 in a manner that allows several inches of total connection length adjustment. The set collar 66 with lock screw can secure this rod and tube at the appropriate length to facilitate the desired activation of the release of the dogging latch mechanism. Typical door sizes vary between 32 in. and 42 in., so the adjustment between the tube 64 and shaft 54 is preferably in the range of 8-16 inches.

Figure 7:
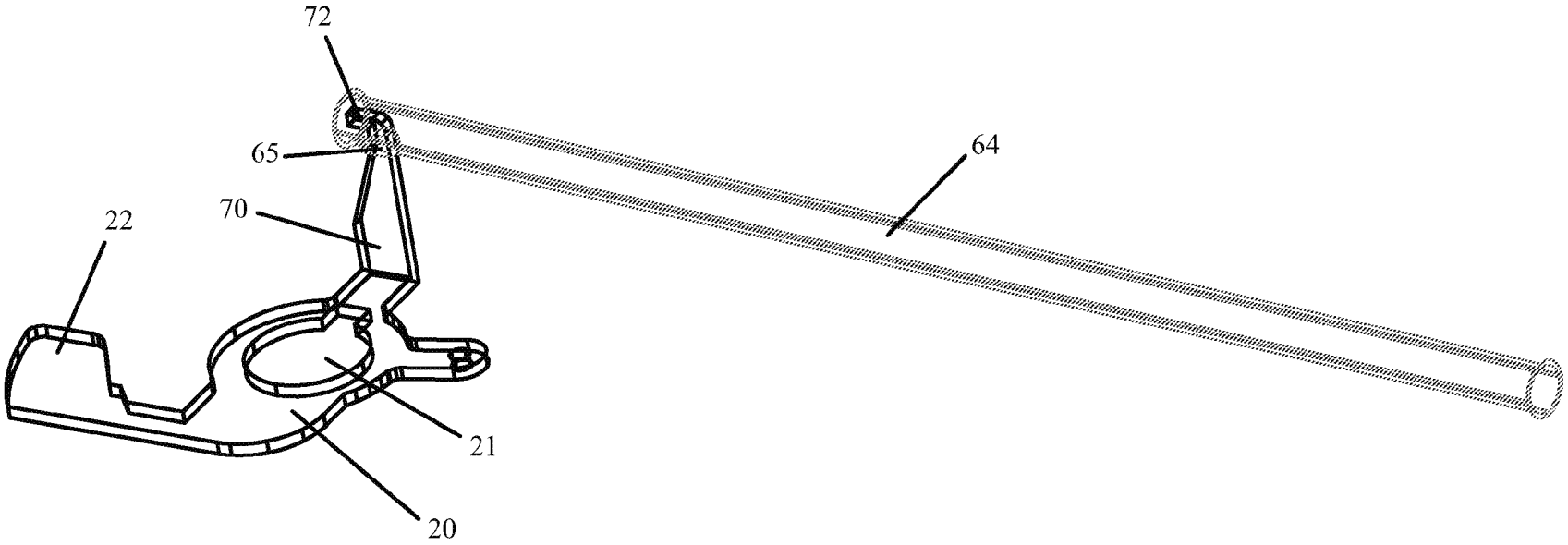
FIG. 7 is an enlarged 3-D view of the dogging latch connector.

The modified dogging latch 20 has a connection lever 70 that projects upward from the latch plate 20, as shown in FIG. 7. The connection lever 70 terminates in a hooked tab 72 that engages the adjustable tube 64 through a hole 65 in end of the tube. The tube 64 will apply a force to the lever 70, whereby rotating the dogging latch plate 20 about the central axis opening 21 of the latch and thereby un-dogging the panic device. This un-dogging of the panic device is the new desired function of the quick panic release invention. As indicated in FIG. 1 the engagement of the hooked tab 72 to the adjustable tube 64 is offset from the central axis through the opening 21 by a distance d that is sufficient to pivot the lever plate 20 from the dogged position of FIG. 1 to the un-dogged position of FIG. 2 in which the latch 22 is clear of the rod 24 of the panic internal mechanism 16.

This proposed invention will only require the replacement of two components of an existing panic bar device, namely the end cap of the housing 12 and the latching plate, and the installation of the quick panic release assembly. An existing panic device can be modified with the quick panic release assembly in a matter of minutes, whereby minimal labor costs are involved in the retrofitting of an existing panic device that has a dogging function.

While the invention has been particularly shown and described with reference to a preferred embodiment, it will be understood by those skilled in the art that various changes in form and detail may be made therein without departing from the spirit and scope of the invention.

What is claimed is:

1. A dogging release mechanism for a panic device in an exit door, the panic device having an elongated housing, a door latch mechanism for operating a door latch at one end of the elongated housing, a panic bar configured to operate the door latch mechanism and a dogging mechanism for holding the door latch mechanism in a dogged or unlocked position, the dogging mechanism including a latch plate rotatably mounted within the housing for rotation by an external key, the latch plate having a latch for engaging the door latch mechanism to prevent operation by the panic bar, the dogging release mechanism comprising:

an end cap configured to be mounted in an end of the panic device housing opposite the one end with the door latch;

a button mounted within said end cap and configured to be manually depressed toward the interior of the panic device housing;

a connecting rod assembly configured to be disposed in the housing of the panic bar device and including one end arranged to be contacted by said button when the button is depressed to thereby transmit a force from the button to push said connecting rod assembly, said connecting rod assembly further including an opposite end engageable to the latch plate so that the force transmitted from the button to push the connecting rod assembly rotates the latch plate thereby rotate the latch away from the door latch mechanism.

2. The dogging release mechanism of claim 1, wherein said connecting rod assembly is configured to have an adjustable length to accommodate different distances between said button in said end cap and the latch plate.

3. The dogging release mechanism of claim 2, wherein said connecting rod assembly is configured to have an adjustable length of 8 in. to 16 in.

4. The dogging release mechanism of claim 2, wherein said connecting rod assembly includes a tube telescopingly mounted over a rod and a set collar configured to lock said tube and said rod together at an adjustable location, and further wherein one of said tube and said rod is arranged to be contacted by said button and the other of said tube and said rod is engageable to the latch plate.

5. A mechanism for a panic device in an exit door, the panic device having an elongated housing, a door latch mechanism for operating a door latch at one end of the elongated housing, a panic bar configured to operate the door latch mechanism and a dogging mechanism for holding the door latch mechanism in a dogged or unlocked position, comprising:

a latch plate rotatably mounted within the housing for rotation by an external key, said latch plate including a latch for engaging the door latch mechanism to prevent operation by the panic bar and a lever separate from said latch;

an end cap configured to be mounted in an end of the panic device housing opposite the one end with the door latch;

a button mounted within said end cap and configured to be manually depressed toward the interior of the panic device housing;

a connecting rod assembly configured to be disposed in the housing of the panic bar device and including one end arranged to be contacted by said button when the button is depressed to thereby transmit a force from the button to push said connecting rod assembly, said connecting rod assembly further including an opposite end engaged to said lever of said latch plate so that the force transmitted from the button to push the connecting rod assembly rotates the latch plate thereby rotate the latch away from the door latch mechanism.

6. The dogging release mechanism of claim 5, wherein said latch plate is configured to be mounted within the panic device housing for rotation about an axis and said lever is radially offset from said axis.

7. The dogging release mechanism of claim 1, wherein said button is spring biased away from the manually depressed position thereof.

8. The dogging release mechanism of claim 1, wherein said one end of said connecting rod assembly is not structurally connected to said end cap button to move with said button when it moves away from the manually depressed position.

* * * * *